US010563404B2

(12) United States Patent
Czintos

(10) Patent No.: US 10,563,404 B2
(45) Date of Patent: Feb. 18, 2020

(54) REINFORCEMENT ELEMENT FOR INCREASING THE STRENGTH OF SELF-SOLIDIFYING PASTY MATERIALS

(71) Applicant: NOVONOVON Zrt., Kecskemét (HU)

(72) Inventor: Csongor Czintos, Kecskemét (HU)

(73) Assignee: NOVONOVON ZRT., Kecskemet (HU)

( * ) Notice: Subject to any disclaimer, the term of this patent is extended or adjusted under 35 U.S.C. 154(b) by 0 days.

(21) Appl. No.: 16/337,146

(22) PCT Filed: Sep. 25, 2017

(86) PCT No.: PCT/HU2017/050040
§ 371 (c)(1),
(2) Date: Mar. 27, 2019

(87) PCT Pub. No.: WO2018/060750
PCT Pub. Date: Apr. 5, 2018

(65) Prior Publication Data

US 2019/0218779 A1 Jul. 18, 2019

(30) Foreign Application Priority Data

Sep. 28, 2016 (HU) ..... 1600552

(51) Int. Cl.
*E04C 5/01* (2006.01)
*E04C 5/07* (2006.01)

(52) U.S. Cl.
CPC ..... *E04C 5/073* (2013.01); *E04C 5/012* (2013.01); *E04C 5/015* (2013.01)

(58) Field of Classification Search
CPC ..... E04C 5/073; E04C 5/012; E04C 5/015
See application file for complete search history.

(56) References Cited

U.S. PATENT DOCUMENTS 957,244 A * 5/1910 Noyes ..... E04C 5/012 52/659
1,065,321 A * 6/1913 Thomson ..... E04C 5/012 52/659

(Continued)

FOREIGN PATENT DOCUMENTS

DE 102006051083 A1 4/2008
EP 2 206 848 A1 7/2010

(Continued)

OTHER PUBLICATIONS

International Search Report for PCT/HU2017/050040, dated Jan. 16, 2018 (4 pages).

(Continued)

*Primary Examiner* — Patrick J Maestri
(74) *Attorney, Agent, or Firm* — Fitch, Even, Tabin & Flannery, LLP

(57) ABSTRACT

Reinforcement element (10) for increasing the strength of self-solidifying pasty materials which is made of bendable filaments, that comprises a central portion (12) from which at least in three directions respective arms (11) extend out and each of the arms (11) have at least two spaced filaments (13), and the arms (11) have outer ends constituted by respective loops (14) made by the bending of the filament (13) of which the associated arm (11) is made, and in each loop (14) the distance between the filaments (13) is between the twice and twenty fifth times of the size of the filament (13), and the arms (11) are arranged in such a way that in any half space separated by any plane lead through the central portion (12) at least one of the arms (11) is arranged.

18 Claims, 5 Drawing Sheets

(56) References Cited

U.S. PATENT DOCUMENTS

| | | | | |
|---|---|---|---|---|
| 1,913,707 | A * | 6/1933 | Etheridge | C04B 20/0008 428/221 |
| 3,616,589 | A * | 11/1971 | Sherard | C04B 20/0008 52/659 |
| 3,913,295 | A * | 10/1975 | Thompson | E04C 5/012 52/659 |
| 5,162,059 | A * | 11/1992 | Rossi | C04B 14/48 106/643 |
| 5,404,688 | A * | 4/1995 | Greaves | E04C 5/012 52/648.1 |
| 5,858,082 | A | 1/1999 | Cruz et al. | |
| 2006/0130709 | A1 | 6/2006 | Miksic et al. | |
| 2010/0101163 | A1* | 4/2010 | Cuevas | E04C 5/0618 52/223.8 |
| 2013/0212974 | A1 | 8/2013 | Sullivan | |
| 2017/0183871 | A1* | 6/2017 | Hattar | E04C 1/00 |
| 2018/0187439 | A1* | 7/2018 | Oliveira De Barros | E04G 23/0218 |

FOREIGN PATENT DOCUMENTS

| | | | |
|---|---|---|---|
| FR | 2460376 | A1 | 1/1981 |
| WO | 01/32341 | A1 | 5/2001 |

OTHER PUBLICATIONS

Written Opinion of the International Searching Authority, dated Jan. 16, 2018 (5 pages).
Written Opinion of the International Searching Authority, dated Oct. 26, 2018 (7 pages).

* cited by examiner

REINFORCEMENT ELEMENT FOR INCREASING THE STRENGTH OF SELF-SOLIDIFYING PASTY MATERIALS

CROSS-REFERENCE TO RELATED APPLICATIONS

This application is a U.S. national phase application filed under 35 U.S.C. § 371 of International Application No. PCT/HU2017/050040, filed Sep. 25, 2017, designating the United States, which claims priority from Hungarian Patent Application No. P1600552, filed Sep. 28, 2016, the complete disclosures of all the applications are hereby incorporated herein by reference in their entirety.

The invention relates to a reinforcement element for increasing the strength of self-solidifying pasty materials which is made of bendable filaments.

The description of the prior art portion of EP 2 206 848 A1 includes a detailed summary the solutions used earlier to reinforce concrete to eliminate the drawbacks of steel rods as reinforcement members, i.e. to eliminate the need of carrying out the costly and difficult assembly works connected with the placement of reinforcement steel elements before the pasty concrete was poured in the jalousie.

These solutions used the feeding and mixing of a high number of smaller reinforcement elements in the concrete when it was still in a pasty state, and following the solidification of the concrete the structure obtained had a higher loadability as without the elements but it could not reach the strength which was provided by an appropriately designed steel reinforcement system. In that publication small coils were placed in water soluble capsules in order to prevent interconnection of the coils during the mixing step and get clogged. Water present in the pasty concrete has dissolved the capsules and the well mixed elements could increase the strength of the structure.

In U.S. Pat. No. 5,858,082 wires with bent ends were folded in U shape but made from remembering wires, and in these shape they were exposed to heat treatment so as to keep their shapes. They were fed and mixed to the pasty concrete and exposed to a second heat treatment, wherein the temperature was increased over the critical "remembering" temperature whereby the coils remembered and took their original open shapes again.

In the document US 2010/0101163 A1 reinforcement elements were used which had a central spherical portion or body from which arms were extended in outward direction, and at the ends of the arms heads were arranged which were larger in size than the arms, and the existence of the heads a higher force transmitting connection was provided between the concrete and the arms. In this solution the embodiment which has a plurality of arms extending out in all spatial directions it is problematic that the central portion takes a large space, the element has high weight and owing to the large body and the several arms extending out in almost all directions the respective reinforcement elements were unable to get closer to each other to reach a high density of insertion. In case of the mixing step owing to the high number of the larger heads at the ends of the arms the respective elements can get into unwanted engagement with each other and an agglomeration can take place. There are embodiments which have planar design. In such elements it cannot be ensured that the elements be positioned after each mixing in a uniform way in all spatial directions, thus a high degree of anisotropy can take place because the elements can get into engagement at their planes.

Out of the widely spread and commercially available reinforcement solutions for concrete the elements having the commercial name DRAMIX can be mentioned which comprise steel wires with a length of 50 or 60 mm and with a diameter of 0.8 mm, wherein the wires are stepped at their end regions. The data sheet of such a structure can be found e.g. at the web address: http://www.sinthaweethailaos.com/images/product/Stee-%20Fiber/1Steel%20Fibre%20-%-20DRAMIX%C2%AE/LOOSE%20Fibres/Dramix Duo100 GB.pdf The examination of concrete tubes reinforced by small reinforcing elements is described in the paper of D. A. Scott et. al., entitled: "Impact of Steel Fiber Size and Shape on the Mechanical Properties of Ultra-High Performance Concrete Geotechnical and Structures Laboratory" published in August 2015, which can be found at the web address: http://www.dtic.mil/get-tr-doc/pdf?AD=ADA620738.

Out of the drawbacks of known composite reinforcement elements without the aim of completeness it can be mentioned that during the mixing process the element tend to get stuck to each other, whereby their spatial distribution will be uneven. Furthermore, because the material of the reinforcement element is steel which is heavier than concrete or of the composite material, therefore after the pouring of the mixture into the final mould they tend to get sunken in the material before it is hardened and their distribution along the height will become uneven. A further drawback lies in that the reinforcement elements do not have a form fitting connection with the composite material but only through the surface adhesion established between them, and this connection is less strong as if a from fitting connection was made. A further drawback is the anisotropic strength of the so reinforced material because the shape of the elements cannot guarantee identical properties in all directions therefore one cannot calculate the strength accurately in advance. The elements tend to get corroded and corrosion starts generally at the edge surfaces of the structures or at its cracking surfaces, which sooner or later will worsen the strength and at the same time the rusted wires will be visible at the outer surfaces which worsen its appearance.

The task of the invention is to provide a reinforcement element for increasing the strength of a self solidifying pasty material and a method for feeding the elements into the pasty material, which can decrease or even eliminate the listed and other drawbacks of known solutions.

According to the invention a reinforcement element has been provided for increasing the strength of self-solidifying pasty materials which is made of bendable filaments, and according to the invention the element comprises a central portion from which at least in three directions respective arms extend out, and each of the arms have at least two spaced filaments, and the arms have outer ends constituted by respective loops made by the bending of the filament of which the associated arm is made, and in each loop the distance between the filaments is between the twice and twenty fifth times of the size of the filament, and the arms are arranged in such a way that in any half space separated by any plane lead through the central portion at least one of the arms is arranged.

It is preferred if the length of the arms is at most ten times as high as their width.

A preferred embodiment comprises an even number of the arms, and at least pair of the arms which extend in opposite spatial directions are made by the bending of a single filament.

It is preferred if the number of the arms is four of which respective pairs are made by the bending of a single filament, and their loops fall in a central portion substantially in a common plane, the pairs that constitute the arms when projected in the common plane fall substantially in respective common straight lines as extension of each other, and the arms in each pair extend out into opposite directions of the common straight line, and one of the pairs constituted by the arms is bent in upward direction from the common plane by a predetermined angle, and the other pair of the arms is bent in the same or nearly the same way in the opposite i.e. downward direction from the common plane.

It is preferred if the angle of the bending of the arms relative to the common plane is between 20° and 50°.

A further advantage comes if the two pairs of arms are fixed to each other by the bending of the filament forming one of the pairs at the central portion.

In a preferable embodiment the filaments have circular cross sections.

It is very advantageous if the reinforcement element is constructed by the bending of a single filament.

The material of the filaments can be steel, copper, carbon fiber, plastic, glass, basalt fiber or the combination of these materials.

Further advantages come from the design if the filaments comprise a coating for corrosion protection and/or for increasing strength.

The spatial distribution will be more uniform if the reinforcement element has an average density controlled by the thickness of the coating so as to be equal or nearly equal with the density of the pasty material.

The strength can be increased if the coating is made of a yarn of carbon fiber or glass fiber which is bound to the filament by means of a binder material.

In a preferred embodiment the filaments are made of double filaments.

According to the invention a method has also been provided for making a structure from a mould material that has an increased strength, comprising the steps of: mixing the material when it is in a pasty state from several components, then pouring it to a jalousie or mould having a required form then letting the material be solidified or set, and according to the invention it comprises the step of feeding an amount of at least 80 kg/m$^3$ of the reinforcement elements made as specified above to the material when it is still in a pasty state, and mixing the added reinforcement elements to be evenly distributed therein and carrying out said pouring step thereafter.

It should be noted that the literature refers to the self solidifying pasty materials also as composite materials.

It is preferred if the pasty material is concrete that has a quality of at least C50 and preferably higher than C 100 but it can also be polyamide polycarbonate or any other similar plastic material or ceramics, glass or a metal.

The invention will now be described in connection with preferable embodiments thereof, in which reference will be made to the accompanying drawings. In the drawing.

Figure 1:
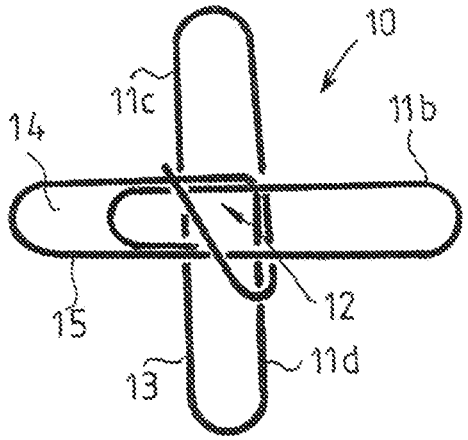
FIG. 1 is the top view of an embodiment of the reinforcement element according to the invention.

Reference is made to FIGS. 1 to 4 which show an embodiment of the reinforcement element 10 according to the invention that has four arms. The reinforcement element 10 has such a spatial configuration that has a predetermined number of arms 11 which extend out from a central portion 12 to different spatial directions. It is furthermore characteristic to the reinforcement element 10 that the respective arms 11 are made from a filament 13 or wire so that respective loops 14 are bent from the filament 13 and a predetermined distance is kept between branches 15 of the loops 14. This distance is between the double and the twelve times of the size (diameter) of the filament 13 (and in case of using non-circular filament this size is the lateral dimension of the filament). Here the upper limit is not critical because greater distances can also be used but in this case the reinforcement element 10 will have a decreased stiffness. The lower limit corresponding to the double size is required because the loop 14 can provide the required effect if the pasty binding material can easily penetrate in the space defined between the branches 15 and can fill the space formed by these branches. The material of the filament 13 is preferably steel, copper, plastic or a version of these materials when reinforced by carbon fiber or carbon ribbon, and its diameter or its greatest transversal size is less than about 3 mm. These limit values are not too critical. The filament 13 must have an appropriately high tensile strength to resist the loads acting thereon, whereas it should be bendable at least during its formation so that it should be capable of the bending of the reinforcement elements 10 or at least a few of its arms 11.

Figure 3:
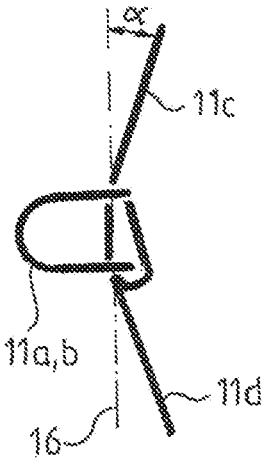
FIG. 3 is the side view of the embodiment shown in FIG. 1.
Figure 2:
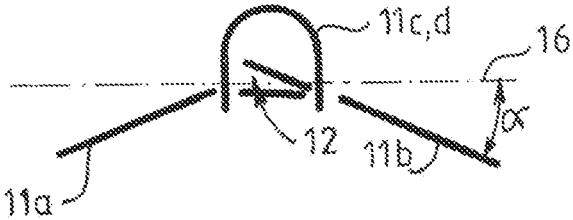
FIG. 2 is the front view of the embodiment shown in FIG. 1.
Figure 4:
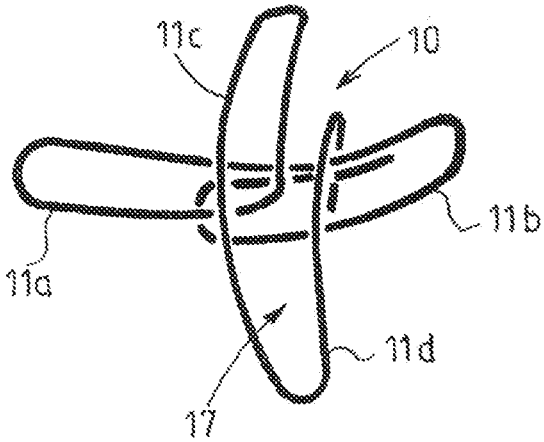
FIG. 4 is the respective view of the embodiment shown in FIG. 1.

In the drawing it can be observed that the central portion 12 of the reinforcement element 10 lies substantially in a plane and in FIGS. 2 and 3 and a straight line that falls in this plane 16 has been drawn by a dash dot line. After leaving the central portion 12 the opposing arms 11 close an angle $\alpha$ with this plane in a direction. It can be seen in FIG. 2 that the two arms 11*a* and 11*b* are inclined by the angle $\alpha$ in downward direction from the plane 16. The other two arms 11*c* and 11*d* are also inclined by the same angle $\alpha$ from the plane 15 but in the opposite half space i.e. in upward direction. The starting line of the bending can be immediately after the central portion 12 as shown in the drawing but it can be further away in outside direction.

All of the arms close an angle α (as absolute value) with the imaginary plane 16. The value of this angle α is preferably between 20° and 50°, however the use of the angular range between 25° and 35° is the most preferred.

A further formal feature of the reinforcement element 10 shown in FIGS. 1 to 4 is the length of the arms 11, i.e. the extent of their projections. During normal use the reinforcement elements 10 are fed in high number into the self solidifying pasty or partially liquid material and will be mixed with it. The objective is to ensure the even distribution of the reinforcement elements 10 in the pasty material by the end of the mixing, and no local aggregation should take place and the angular position of the respective reinforcement elements 10 will be evenly distributed among the possible directions. The quality of the mixing is substantially influenced by the length of the arms 11 and by the angle α. With the suggested angular range it is preferred if the arms 11 are not longer than ten times the distance between the branches 15. This is not an absolute limit but if the arms 11 are shorter than this size, then the danger of mutual engagement of the arms is less. Of course the length of the arms also has a lower logical limit but this limit is not too critical from the point of view of the quality of mixing, whereas in case of too short arms among the arms of the randomly closely located reinforcement elements.

Beside the length of the arms 11 the aggregation and mutual engagement between the elements will be prevented by the presence of bent loops as arced arm-ends which differs from the ending of the filaments in sharp tips. The significance of the loops 14 is high because in addition to ensuring a homogenous mixing the interconnection of the ends of the spaced branches 15 of the arms 11 by respective arced loops 14 defines respective openings 17 in every branch 15. The pasty mould material can pass through these openings 17 and fills them completely, and following the setting of the material the loop 14 will be held not only by the adhesion forces between the mould material and the filament 13 but primarily the form fitting connection provided by the binding material finally set in and through the loop 14. The essence of this kind of connection lies in that the set material encircled by the loops 14 constitutes a single body with the loops 14 on the arms of the neighboring reinforcement elements 10, and if a tensile load acts at a given cross section of the concrete then the other arms of the reinforcement elements 10 will exercise a pressure on the concrete and the concrete has a good resistance against pressures. Of course in certain parts of the filaments 13 of the reinforcement element 10 tensile forces will be generated, but the reinforcement elements 10 have much higher tensile strength than what concrete has. This is just the reason of the appearance of higher load endurance coming from the presence of the reinforcement elements 10. Additionally the fact that the loops 14 embrace the self setting material after having flown in the openings 17 formed by the branches 15 of the arms 11 much higher force fitting connections will be generated between the embraced material and the reinforcement element 10 as if this connection was provided only by the adhesion forces between the filaments 13 and the self setting material. In case of classically designed reinforced concrete this is the typical type of the connection between the steel reinforcement wires and the surrounding concrete material. Such connections will be established between the conventional reinforcement elements and the surrounding self-setting material. This form fitting, embracing type connection is independent from the type and quality of the filaments 13 constituting the reinforcement elements 10, therefore it is also possible that the filaments 13 are made from special materials that have less adhesion to the pasty material. This property is the source of several preferred features which will be explained in later parts of the present specification.

The reinforcement element 10 shown in FIGS. 1 to 4 has an important property, i.e., it can be made by a single continuous filament 13 only by bending. This property has the significance that the reinforcement element 10 does not have separate parts which should be connected by separate method steps and this improves its strength and loadability. Although the manufacture by a single filament has several advantages its use is not always necessary. The respective arms or arm pairs of the reinforcement element 10 can be made as separate parts which can be connected by conventional ways (e.g., by welding, soldering or using a binder).

Although the design of the reinforcement element 10 is preferred, FIGS. 5 to 8 show further alternative embodiments.

Figure 5:
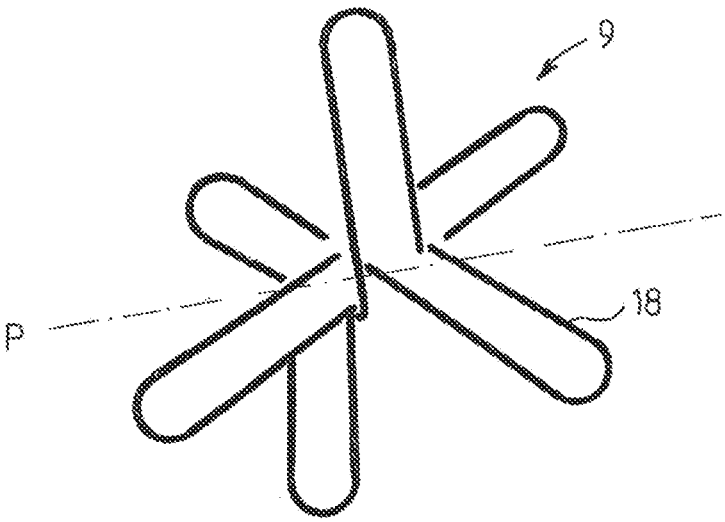
FIG. 5 is the perspective view of an embodiment having six branches.

FIG. 5 shows a reinforcement element 9 that has six arms 18, which can be also made by a single filament by bending. The opposite arms 18 fall substantially in the same straight line and constitute the diagonals of an imaginary cube. The further increase of the number of the arms is not preferred because this might prevent the positioning of such reinforcement elements 9 close to each other which have the consequence that it is not possible to feed and mix the required amount from them into a predetermined volume of the pasty material. This effect of the reinforcement elements of keeping distances from each other can be hardly experienced when the embodiment shown in FIGS. 1 to 4 is used, because these reinforcement elements 10 have more open shapes and do not prevent the close placement of other similar elements to one another.

The spatial arrangement and the number of the arms 11 can be visualized or made understood if a spatial imaginary plane is chosen that can take any direction but a straight line P can be placed in this plane which line fits to the central portion 12 of the reinforcement element 10 or 9, and this straight line P has been shown in FIG. 5 by a dash dot line. The plane divides the space around in two halves and in each half roughly the same number of the arms 11 should fall. This condition expresses that the arms 11 of the reinforcement elements extend out in the space in an even distribution i.e. there is no preferred direction for the arms 11 to which more arms would extend than in any other direction.

Figure 6:
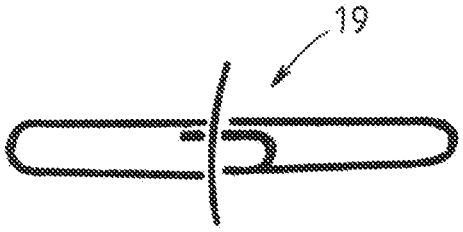
FIG. 6 is the perspective view of an embodiment of the reinforcement element viewed from above.

FIG. 6 shows a reinforcement element 19 which has in contrast to the one shown in FIG. 5 only three arms which are all bent, but in the given projection of the drawing the bending and the angle of inclination of the arms are not clearly illustrated, but the rule defined in the previous paragraph is also applicable to this embodiment.

Figure 7:
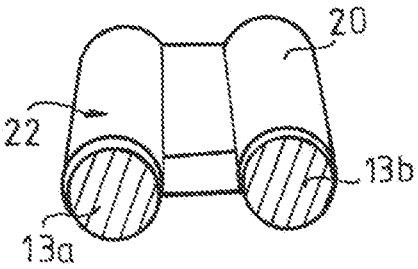
FIG. 7 shows a detail of a double filament forming the reinforcement element.
Figure 8:
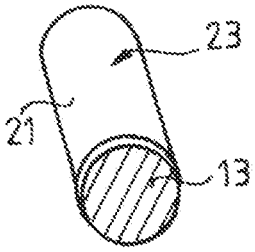
FIG. 8 is a detail of the filament that forms the reinforcement element comprising a plastic coating.
Figure 9:
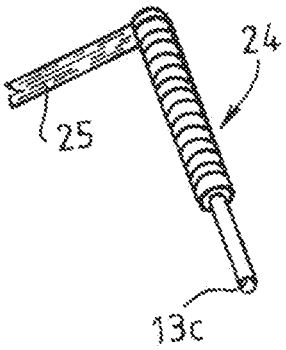
FIG. 9 shows the perspective view of a filament 24 coated by a carbon fiber.

The preferred design of the filaments 13 that can be used to form the reinforcement elements 10, 9, 19 is shown in FIGS. 7 to 9. In FIG. 7 a twin filament 22 is shown that comprises a pair of filaments 13*a* and 13*b* led parallel to each other which are encircled and connected by a plastic coating 20. In FIG. 8 filament 23 is encircled by a cylindrical flexible plastic coating 21. The manufacture of the coatings 20, 21 can use similar materials and technologies which is used generally for making insulated electrical cables, but it is preferred if the size and mass of the coating 20, 21 is chosen in such a way that the resulting density of the filaments 22, 23 made in this way will be equal to or nearly equal to the density of the pasty self setting binding material which will encircle them during use. In case of concrete as pasty material if the filaments 13, 13*a* or 13*b* are made of steel and the coatings 20, 21 are made by a plastic material, the volume of the coating 20, 21 should be chosen preferably around 2.6 to 2.8 times of the volume of the steel. When this condition is kept, the density of the reinforcement elements 10 made in such a way will be the same as the density of concrete and when the elements 10 are fed in the pasty concrete they will not get sunk in the surrounding medium.

FIG. 9 shows a filament 24 which has a steel inner filament 13*c* and around this filament 13*c* a ribbon 25 is wound which is made of spun carbon or other strong fibers and this fiber structure is bound to the inner filament 13*c* by a binder. When choosing this embodiment the filament 24 should be bent for making the reinforcement element 10 before the plastic binder sets. The use of this embodiment is preferred and justified for use in concrete structures exposed to very high loads because the carbon-fiber reinforced material has a tensile strength around 5000 to 8000 MPa, whereas the tensile strength of steel is typically between 800 and 1500 MPa, i.e. the tensile strength of the filament 24 is at least by five times higher than that of steel, or even higher. Instead of carbon fibers strands made of glass fibers, of basalt or of other plastic fibers can be used if they have the required strength.

In case the filament 13 is made of steel, it is preferred if it is coated or plated by a thin zinc layer which protects it from corrosion.

The outer surface of the filament 13 can be made from materials that have much less adhesion to concrete or to the other self setting pasty material, because during using the reinforcement element 10 the transmission of forces is taken by the presence of the loops 14 which encircle certain small volumes of the self setting pasty material, whereby the adhesion between the coating and the pasty material has only a subordinated role.

The use of the reinforcement elements 10 according to the invention takes place primarily for increasing the strength of different mould structures. Of the self setting pasty materials the more generally used one is concrete, but there is an ever increasing need of strengthening plastic structures which are made e.g. of polyamide, polypropylene, polyester or other thermoplastic material with comparable properties. In a similar way one can strengthen in this way composite materials made by using multi component self-setting or thermo setting materials.

During the method of use the pasty and partially liquid self setting material is mixed in an appropriate vessel and during the mixing step a predetermined amount of the reinforcement elements 10 is fed in the mix. The mixing is continued until the required homogeneity is reached then the material is poured in a space surrounded from below and from all sides and appropriate jalousie or mould, then in case of need the material is handled by a vibrator for removing the superfluous air bubbles and storing the mould in this state until it is set. In case of need the outer surface is sprinkled (required e.g. in case of concrete).

The amount of the fed reinforcement elements 10 influences the strength of the so made structure, and by increasing the amount the strength can be increased until a given extent. The amount that can be added is limited only by the ability of the material to receive these elements. In case of concrete the lower limit of the adding of the reinforcement elements 10 is around 70-80 kg/m$^3$ (in case the reinforcement element is made of steel) and the required strength is attained with a dose about 150 to 200 kg/m$^3$. The quality of the concrete should be sufficiently good, the lower limit of the preferred range is at the quality of C 50 which does not exclude the use of concrete with lower quality but there the increase of strength will be less noticeable. The quality has no upper limit but there is no sense of using concrete with higher quality than around C 500, or if yes, only for special purposes.

With the reinforcement element 10 of the present invention numerous experiments, tests and comparative measurements have been carried out in order to better learn its properties and to ascertain that these properties are present in all cases. Before the detailed description of the experiences a few tests and the results obtained will be described.

Figure 10:
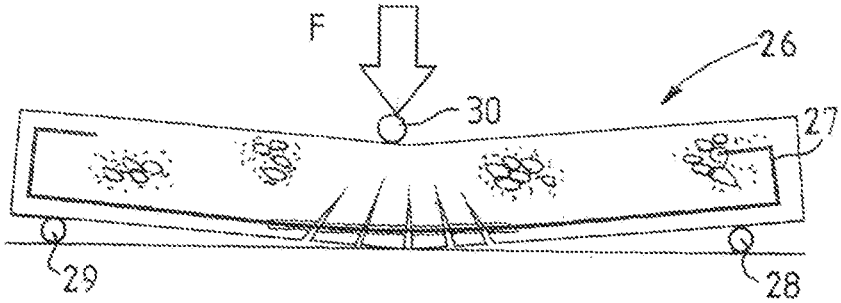
FIG. 10 shows the sketch of a test arrangement for measuring a conventional probe 26 made according to the invention.
Figure 12:
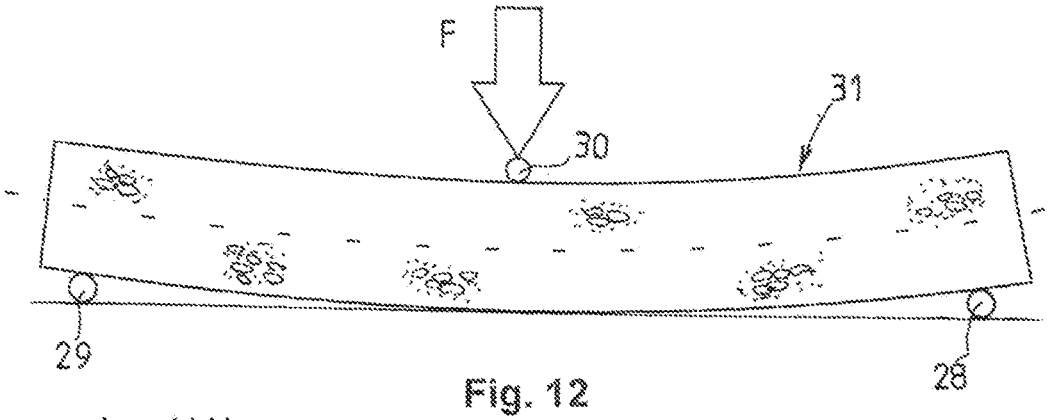
FIG. 12 shows the sketch of a measuring arrangement using the probe 31 made according to the invention, similar to what has been shown to FIG. 10.

FIGS. 10 and 12 show the test arrangement used for the examination of bending strength. For the test probe pieces were made with a square cross section of 150×150 mm and with a length of 600 mm. FIG. 10 shows a probe 26 made in a conventional way, wherein in the lower part thereof a pair of laterally spaced steel wires 27 were placed that have backwardly and upwardly bent end portions as shown in the drawing, and the diameter of the wires was 8 mm. The quality of the concrete was C 25. During the test a pair of support cylinders 28, 29 were placed on a horizontal support surface with a distance of 500 mm. The load was acted in the form of a vertical force F on a pressing cylinder 30, and the vertical displacement (bending) of the lowest central point of the probe 26 was measured as a function of the force F.

With the method according to the invention a probe 31 with the same dimensions was made by using concrete with quality C 110 and in this concrete the reinforcement elements 10 shown in FIGS. 1 to 4 were added in an amount of 100 kg/m$^3$. The diameter of an imaginary sphere in which the reinforcement elements 10 could be fitted was 30 mm, the diameter of the branches 15 was 0.9 mm and the distance between the branches 15 of the arm 11 was 6 mm, and the filament was made of steel.

For a further comparison a similar size probe was prepared by adding conventional reinforcement elements sold under the commercial name DRAMIX ZC-50/0.8 also with a density of 200 kg/m$^3$. The length of the steel reinforcement elements was 50 mm, their diameter was 0.8 mm and the two ends were twice stepped. Finally a further test was made by using a further probe of the same size with a concrete piece made of C 25 concrete and into which no reinforcement element was added.

Figure 13:
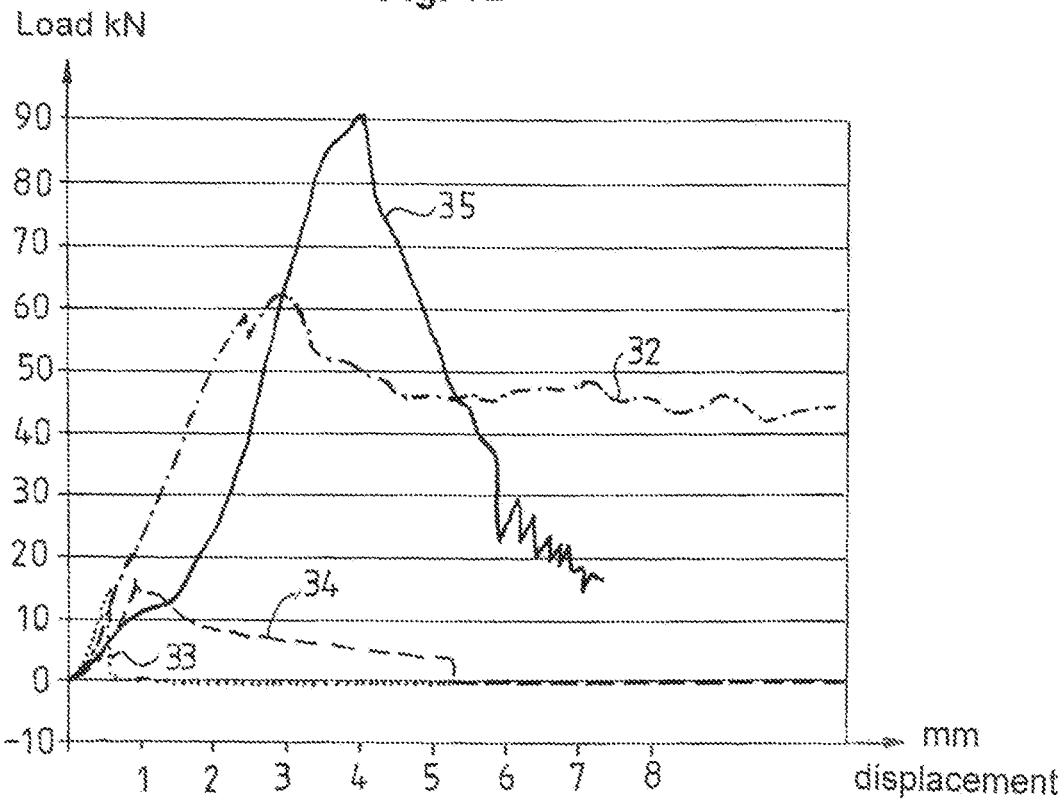
FIG. 13 show load-displacement diagrams carried out with different probes.

The results are shown in the diagrams of FIG. 13. Curve 32 drawn by dashed-dot lines relates to the probe 26 reinforced by conventional steel rods. Curve 33 drawn by the thin dotted line relates to the concrete probe without any reinforcement and shows the without reinforcement concrete can resist very small loads only and breaks soon. Curve 34 drawn by dashed line concerns the probe in which the concrete was reinforced by the DRAMIX reinforcement elements. Finally, curve 35 drawn by full line relates to the probe 31 made according to the invention. It can be seen without any specific explanation that the concrete that comprises the reinforcement elements 10 has an outstanding strength and resistance. Its loadability compared to the conventionally reinforced concrete probe 26 is 90/60 i.e. by 50% higher than that of conventional reinforced concrete, and it will not break after having reached the maximum and it resists even further long deflections past the maximum load, which is a very favorable property in case when pulse like loads may take place. Its strength is five times higher than the same size concrete reinforced by DRAMIX elements, and it is important to note that this strength is maintained in case of loads coming from any direction.

Figure 14:
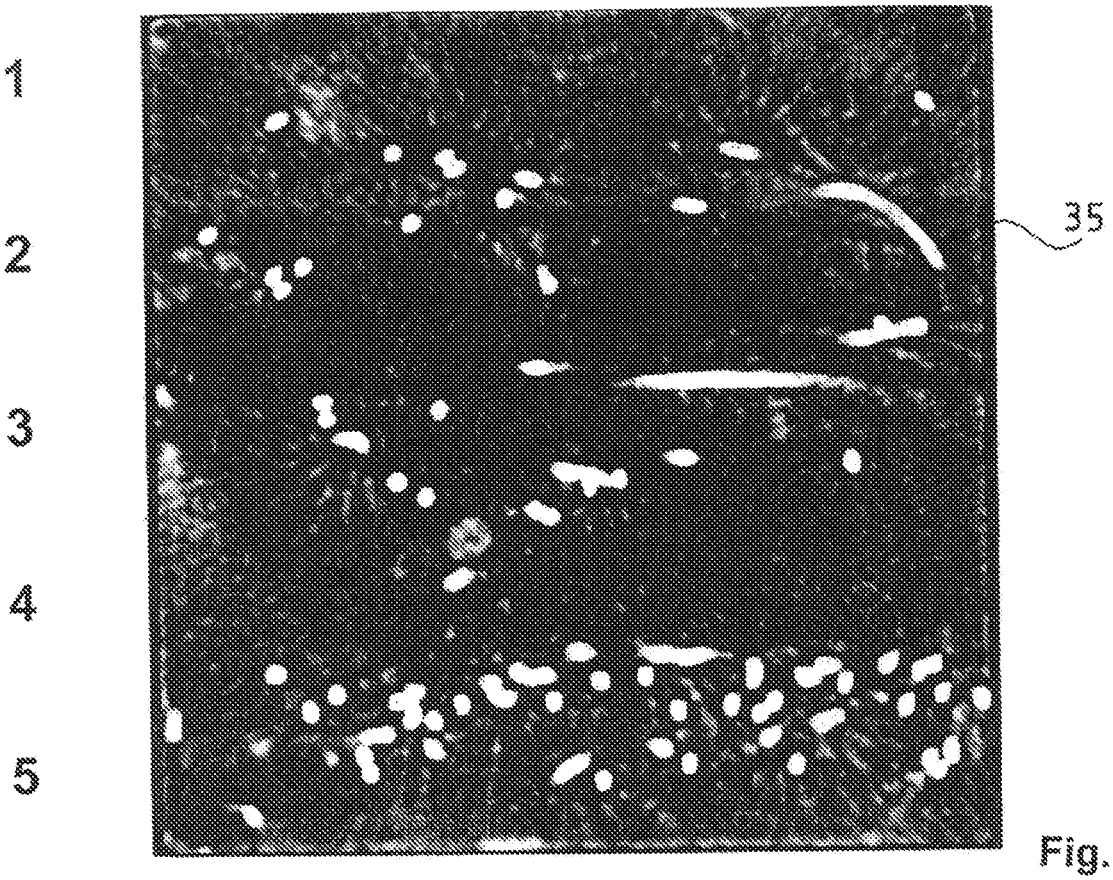
FIG. 14 is a layered X.ray picture made from a probe cube 35 reinforced by Dramix elements.

Reference is made now to FIGS. 14 to 17 in which a further property of the solution according to the invention will be shown. From the concrete reinforced by Dramix elements as described in the foregoing example probe cubes 35 were made with a size of 150 mm edge length, and similar probe cubes were made by the concrete reinforced according to the invention as described at the probe 31, and the two cubes with 150 mm edge length were examined by a computer tomography and a high number of X ray pictures were made at different cross sections. FIG. 14 shows a typical one of the layered pictures taken from the probe cube 35 reinforced by the known elements.

Figure 15:
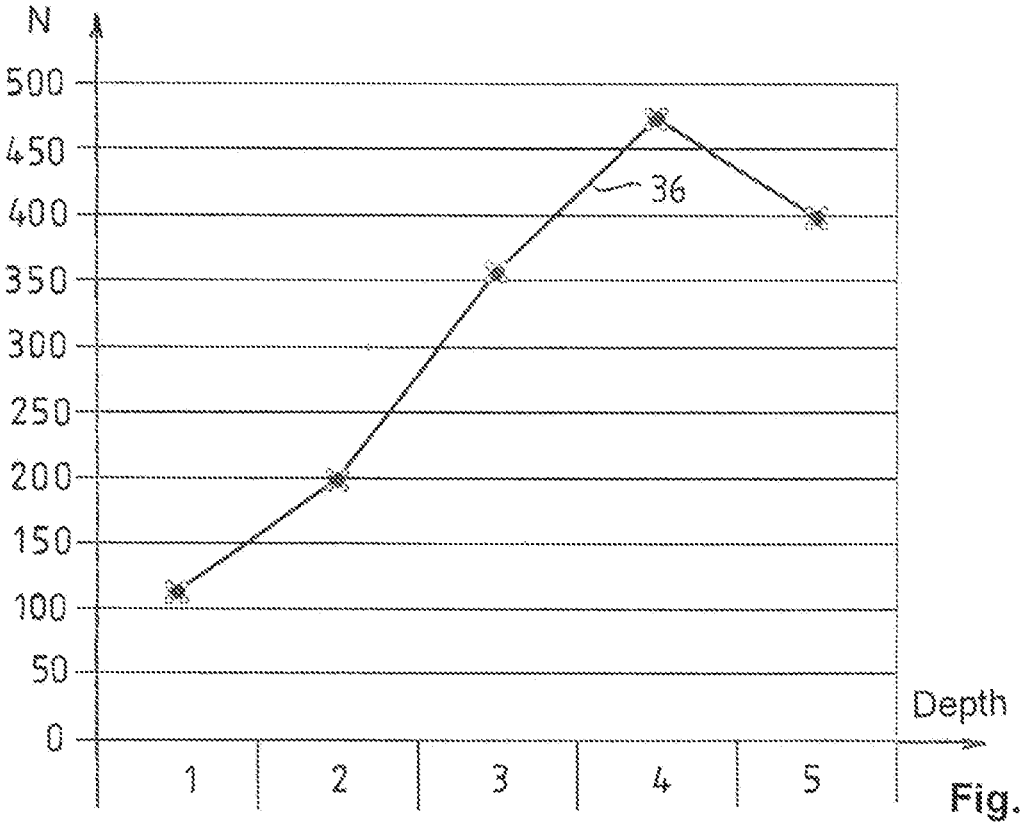
FIG. 15 shows the distribution of the number of the reinforcement elements in the probe cube 35 according to the height.

The quadratic recording shows the probe cube 35 in the position as it was mould i.e. the numbers 1 to 5 show the height, wherein #1 corresponds to the uppermost and #5 to the lowest height band. In the recording the light spots are the pictures of the reinforcement elements in the concerned layer, which are partly small circles and partly shorter or longer stripes depending on the position of the elements in the cube. The records taken at different heights made the counting of the number of the reinforcement elements in the associated heights possible. Looking at the picture of FIG. 14 it is immediately apparent that the white spots that correspond to the reinforcement elements have a higher density in the lowest band 5 while in the upper bands much less elements can be seen. Diagram 36 of FIG. 15 shows the counted number of the reinforcement elements in the respective height bands. It can be seen that in band #1 only about 100 elements were counted, and this number has gradually increased towards moving to the bottom and between the bands #4 and #5 it has reached its maximum of 460 pieces. The change i.e. the extent of unevenness was 4.7 times. This increase of the density in downward direction is due to the fact that the steel reinforcement elements are heavier than concrete and they tend to fall down in the pasty or liquid concrete. The reason why the most of the elements are not in the lowermost height lies in that the elements can take any angular position and when one of their ends reaches the jalousie it cannot move further down.

Figure 16:
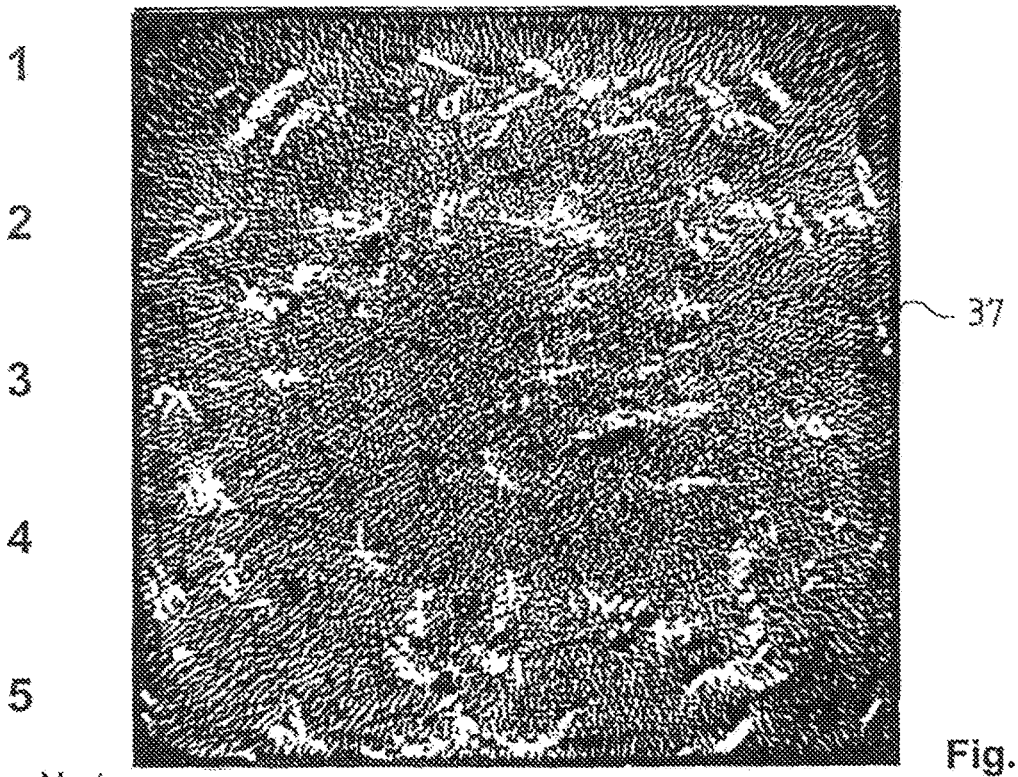
FIG. 16 is similar to FIG. 14 and shows a record taken on a probe cube 37 prepared according to the invention.
Figure 17:
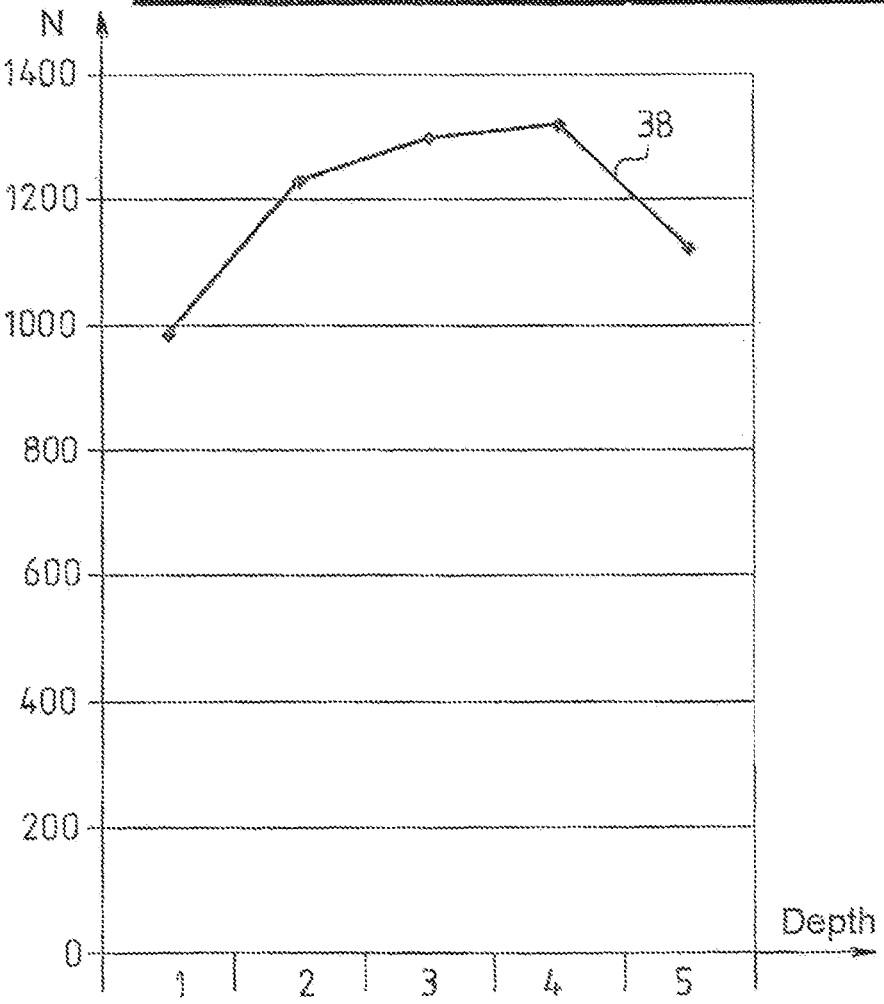
FIG. 17 shows the distribution of the number of the reinforcement elements in the probe cube 37 according to the height.

FIG. 16 is a similar layer recording taken from the probe cube 37 comprising the reinforcement elements 10 according to the invention. When looking at the picture it can be immediately seen and established that the distribution of the element is much more uniform along the height. The differing sizes of the white spots show that the reinforcement elements 10 take different positions and their projected spots are therefore smaller or greater. FIG. 17 is similar to FIG. 15 and shows the number of the counted reinforcement elements 10 at the respective heights. Diagram 38 is more shows a more uniform distribution and at the same time the number of the elements is significantly higher. The smallest number is 100 and the highest is 1200 i.e. the extent of unevenness is 32% in contrast to the value of 470% in the control case.

It should be noted that the unevenness in transversal direction was small in case of both probe cubes 35, 37 because in transversal direction the effect of gravity is insignificant.

Figure 11:
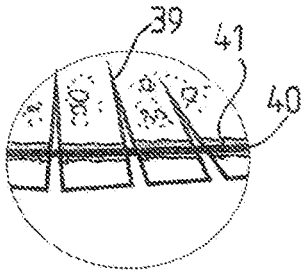
FIG. 11 shows an enlarged sectional detail of FIG. 10.

Reference is made again to FIG. 10 in which the conventional probe 26 was shown made of conventional steel reinforced concrete in a slightly distorted scale when it is slightly bent under the effect of the load. Because the lower layers of concrete slightly expand under the effect of the load the reinforcement still rods are also expand, and as a consequence slight cracks will appear in the concrete material which are shown in a slightly exaggerated scale. FIG. 11 shows such cracks 39 in enlarged view wherein one can observe the steel rod 40 and the surrounding gravel particles 41. The presence of the cracks 39 at the surface of the loaded concrete structure which is exposed to expansion can be regarded as a natural phenomenon, whereas along the cracks 39 under the effect of humidity in the ambient air or of the presence of local damp the steel rod 40 is exposed to corrosion which can cause problems with time, especially because corroded iron has three times as high volume as that of the steel. The local increase of volume causes tensions in the concrete material and causes further cracks and the corrosion process decreases the strength of the concrete with time.

In contrast with the above the structure made according to the invention and shown in FIG. 12 no cracks are formed because the expansion of the small reinforcement elements 10 is much less in size and it loads the surrounding concrete with pressure and not with pulling forces so that the reason of the generation of cracks is excluded. This effect results in the decrease or elimination of the danger of corrosion and substantially increases the useful lifetime of the structure. The danger of corrosion is further decreased if the filament 13 is provided with zinc or plastic coating.

It is worthwhile to analyze and list the grounds that cause together the advantageous effects with respect to the known reinforcement elements. These grounds are summarized below not in the order of their importance.

It has been mentioned earlier that the force transmitting connection between the reinforcement elements 10 and the surrounding pasty material is due to the connection between the initially pasty material that has flown through the loops 14 and the loops 14 themselves which hold the material after it has been solidified and this connection is different from the frictional and adhesion connection between the filament 13 and the ambient medium. Apart from the fact that in this way higher forces can be transmitted the possibility opens to cover the material of the filament 13 with a corrosion resistant layer or even with a fibrous coating that increases tensile strength or with a plastic coating under the effect of which the resulting density decreases in the desired extent.

The presences of the arms of the reinforcement element that extend out in not too high angles in different directions are very useful during the mixing step because no local agglomeration or mutual engagement of the elements will take place. If an arm of a reinforcement element slides in a loop of an arm of another reinforcement element then under the effect of forces during mixing it can slide out therefrom in an easy way, therefore there is no reason which would interconnect during the mixing operation the neighbouring reinforcement elements. The agglomeration of the reinforcement elements is experienced at all known types of such elements.

A further problem is caused the previously mentioned danger for the reinforcement element to get sunk in the fluid medium. The arms of the reinforcement element 10 extend out in all directions and act as a parachute, which increase the drag against movement in the fluid, and there is no special direction along which this effect could not take place. Furthermore the gravel particles can contact the arms of the reinforcement elements 10 and provide a local support and prevent their displacement in the medium. Because of the here listed reasons the sinking effect will be smaller even if the specific density is not decreased by the use of a plastic coating that adjusts the specific density.

By excluding the danger of agglomeration a further advantage follows, namely in a unity volume much more reinforcement elements can be placed whereby the effect of strengthening also increases. The numbers shown in FIGS. 16 and 18 are compared this effect has been confirmed by the experiments and much more reinforcement elements were found in the concrete sample using the present invention.

The arms 14 of the reinforcement element 10 have ends constituted by the associated loops 14 which can contact the jalousie along respective points only. Accordingly, after the jalousie has been removed the presence of the reinforcement elements 10 are indicated at most only small spots and not long wire surfaces as it is the case at known reinforcement elements. Metal wires that extend till the outer surfaces of the readymade structures are at the same time corrosion centres and they significantly destroy the appearance of the outer surfaces. In case of using the reinforcement elements 10 according to the invention, even if no anti corrosion coating is used only small spots can be seen but in case of zinc-plated or plastic coated design the danger of rusting cannot appear.

The next important property lies in that in case of the reinforcement elements 10 there is no preferred direction and as a result of the good mixing and of the law of high numbers the arms face into all directions and the strength is fully isotropic i.e. it prevails in case of loads coming from any direction. This is a substantial advantage over the previously used solutions because there was the danger of having local anisotropies just as a consequence of the agglomeration of the elements.

As a result of the listed effects, the structures using the reinforcement elements 10 according to the invention can be dimensioned and designed for any given loads and the problem will not take place that the load bearing properties would change and depend on the technology used and the circumstances of manufacture.

Finally, it should be mentioned that there can be several additional advantageous properties because for instance the diagrams shown in FIG. 13 have supported that a substantial increase in the strength has been experienced, and if there is a need of a still higher increase of loadability then the carbon fiber reinforced coating shown in FIG. 9 much stronger structures can be obtained.

The invention claimed is:

1. A reinforcement element for increasing the strength of self-solidifying pasty materials which is made of at least one bendable filament, the reinforcement element comprising a central portion that lies substantially in a plane, at least three arms that extend out from the central portion in different spatial directions, each of the arms comprising a respective loop, which is obtained by bending the bendable filament of which the associated arm is made, each loop having an outer end interconnecting two spaced branches formed by said bent filament of each said loop, in each loop the branches are substantially parallel to each other so that the distance between the branches is between twice and twenty-five times of the size of the filament, and the arms extend out from the central portion in an even distribution so that there is no direction in which the arms extend out to which more arms would extend than any other direction.

2. The reinforcement element according to claim 1, wherein the length of the arms is at most ten times greater than their width.

3. The reinforcement element according to claim 1, wherein the arms are bent at an angle ($\alpha$) of between 20° and 50° relative to the plane.

4. The reinforcement element according to claim 1, wherein the filament has a circular cross section.

5. The reinforcement element according to claim 1, wherein the at least one bendable filament further comprises a coating for corrosion protection and/or for increasing strength.

6. The reinforcement element according to claim 5, wherein the coating is made of a yarn of carbon fiber or glass fiber which is bound to the filament by means of a binder material.

7. The reinforcement element according to claim 1, wherein the filament is formed from two connected and paired filaments.

8. The reinforcement according to claim 1, wherein the reinforcement comprises an even number of arms.

9. The reinforcement element according to claim 1, wherein the at least one bendable filament is comprised of steel, copper, carbon fiber, plastic, glass, basalt fiber or a combination of these materials.

10. The reinforcement element according to claim 5, wherein the at least one bendable filament is characterized by having an average density controlled by the thickness of the coating so as to be equal or nearly equal with the density of the pasty material.

11. A method for making a structure from a mould material that has an increased strength, comprising the steps of:

feeding a plurality of reinforcement elements according to claim 1 to the material when it is still in a pasty state in an amount sufficient to obtain least 80 kg/m$^3$, mixing the material when it is in a pasty state from several components to obtain a mixture including reinforcement elements, whereby the reinforcement elements are evenly distributed in the mixture, pouring the mixture into a form or mould having a required form, and then letting the material be solidified or set.

12. The method according to claim 11, wherein the pasty material is concrete that has a quality of at least C50.

13. The method according to claim 12, wherein the pasty material comprises concrete having a quality greater than C 100.

14. A reinforcement element for increasing the strength of self-solidifying pasty materials which is made of at least one bendable filament, the reinforcement element comprising a central portion that lies substantially in a plane, at least three arms that extend out from the central portion in different spatial directions, each of the arms constituted by a respective loop made by the bending of the bendable filament of which the associated arm is made, each loop having an outer end interconnecting two spaced branches formed by said bent filament of each said loop, in each loop the branches are substantially parallel to each other so that the distance between the branches is between twice and twenty-five times of the size of the filament constituting the loop, provided that when an arm is made from separate filaments those filaments are interconnected at the central portion, the arms extend out from the central portion in an even distribution so that there is no direction in which the arms extend out to which more arms would extend than any other direction.

15. The reinforcement element according to claim 1, wherein the reinforcement element is constructed by bending a single filament.

16. The reinforcement element according to claim 1, wherein the reinforcement element has four arms arranged in respective pairs starting from said plane of said central portion, wherein the arms in each pair extend out in opposite directions and the direction of the first pair of arms is normal to the direction of the second pair of arms, and one of the pairs constituted by the arms is bent in an upward direction from the plane by a predetermined angle ($\alpha$), and the other pair of the arms is bent in the same or nearly the same way in the opposite direction from the plane.

17. The reinforcement element according to claim 14, wherein different ones of said arms are made from separate filaments provided that those filaments are interconnected at the central portion.

18. The method according to claim 11, wherein in the pouring step the pasty material is poured into a mould having a required form.

* * * * *